US007178181B1

(12) United States Patent
Fulmer

(10) Patent No.: US 7,178,181 B1
(45) Date of Patent: Feb. 20, 2007

(54) PORTABLE HOIST SYSTEM FOR ASSISTING IN THE MOVEMENT OF A DISABLED PERSON

(76) Inventor: Lester L. Fulmer, No. 9 Concho Rd., Edgemont, AR (US) 72044

( * ) Notice: Subject to any disclaimer, the term of this patent is extended or adjusted under 35 U.S.C. 154(b) by 135 days.

(21) Appl. No.: 11/049,043

(22) Filed: Feb. 2, 2005

(51) Int. Cl.
*A61G 7/14* (2006.01)

(52) U.S. Cl. ..... 5/83.1; 5/81.1 R; 4/562.1; 212/179

(58) Field of Classification Search ..... 5/81.1 R, 5/83.1, 87.1; 4/561.1, 562.1, 564.1; 212/179, 212/280
See application file for complete search history.

(56) References Cited

U.S. PATENT DOCUMENTS

| | | | | |
|---|---|---|---|---|
| 562,725 | A * | 6/1896 | Hepburn | 5/87.1 |
| 1,584,117 | A * | 5/1926 | Mitchell | 212/176 |
| 1,668,242 | A | 5/1928 | Griffith | |
| 2,187,283 | A | 1/1940 | Scheutz | |
| 2,419,145 | A * | 4/1947 | Kersenbrock et al. | 414/672 |
| 2,862,628 | A * | 12/1958 | Coates et al. | 212/292 |
| 3,104,399 | A | 9/1963 | Dalton | |
| 3,413,662 | A | 12/1968 | Stayton | |
| 3,996,631 | A | 12/1976 | Fields | |
| 4,183,106 | A | 1/1980 | Grimes et al. | |
| 4,399,570 | A | 8/1983 | Tracy et al. | |
| 4,498,204 | A | 2/1985 | Warner | |
| 4,554,691 | A | 11/1985 | Daugherty | |
| 4,606,082 | A | 8/1986 | Kuhlman | |
| 4,905,327 | A | 3/1990 | Boublil | |
| 4,928,330 | A | 5/1990 | Moore | |
| 5,263,207 | A | 11/1993 | Gilbert | |
| 5,279,004 | A | 1/1994 | Walker | |
| 5,365,618 | A | 11/1994 | Gilbert | |
| 5,459,891 | A | 10/1995 | Reeve et al. | |
| 5,477,574 | A | 12/1995 | Skoe | |
| 5,572,921 | A | 11/1996 | Krumbeck | |
| 6,070,278 | A | 6/2000 | Smith | |
| 6,082,561 | A * | 7/2000 | Bembas | 212/180 |
| 6,170,612 | B1 | 1/2001 | Krumbeck | |
| 6,289,534 | B1 | 9/2001 | Hakamiun et al. | |
| 6,378,659 | B1 | 4/2002 | Krumbeck | |
| 6,401,863 | B1 * | 6/2002 | Kirkland | 182/142 |
| 6,464,208 | B1 | 10/2002 | Smith | |
| 6,718,572 | B2 | 4/2004 | Schroeter | |

* cited by examiner

*Primary Examiner*—Alexander Grosz
(74) *Attorney, Agent, or Firm*—Fellers, Snider, et al.; Bill D. McCarthy

(57) ABSTRACT

A hoist and associated method for erecting the hoist for assisting movements of disabled persons. The hoist has a fixed-length stanchion that is supportable at opposing longitudinal ends thereof by first and second support members that are, in turn, fixed to a facility structural framework. The stanchion is removable from the support members without detaching any of the support members from the facility structural framework.

15 Claims, 4 Drawing Sheets

PORTABLE HOIST SYSTEM FOR ASSISTING IN THE MOVEMENT OF A DISABLED PERSON

FIELD OF THE INVENTION

The embodiments of the present invention are directed generally to assisting the movements of disabled persons, and more particularly but without limitation, to a system and associated method for removably attaching a hoist to a facility structure.

BACKGROUND

Specialty lifting devices are designed to aid in the movement of disabled persons for otherwise routine matters, such as accessing a bathing or restroom facility. Clearly, the lifting devices necessarily must be structurally sound to safely lift and transport the person. Unfortunately, the resulting design solution often yields an obtrusive and inflexible device.

For example, some design solutions involve erecting an overhead rail and supporting a lifting mechanism from the rail. Such solutions are relatively expensive to install, especially where the rail extends between rooms such as is needed to move a person from a bed to a restroom. Such design solutions are also inflexible for use beyond the reach of the predefined extent of the rail.

Other design solutions entail attaching an upright stanchion member to the facility structural framework and supporting a lifting mechanism from the stanchion. Although relatively less expensive than an overhead rail, such solutions are likewise inflexible for use beyond the reach of the predefined position of the stanchion. Where a one-point attachment of the stanchion is used, such as attaching the stanchion to the floor, the size and permanent placement of the stanchion is usually obtrusive to conducting other activities in the room. Where a two-point attachment is used, such as attaching the stanchion to the floor and ceiling, then either the stanchion is permanently sandwiched between the opposing supports or the stanchion is telescopingly extended to engage the supports. The former alternative yields a permanent, likewise obtrusive device, and the latter reduces the strength of the stanchion.

Other design solutions involve self-contained devices provided with casters for rolling the lifted person about. Such mobile support of person can present safety hazards in maneuvering the lifting vehicle across various floor materials and grades.

There is a need for a relatively inexpensive lifting device having the necessary strength and durability of a permanent fixture, yet easily movable from one place to another. It is to these advantages and features that the embodiments of the present invention are directed.

SUMMARY

Embodiments of the present invention are generally directed to an apparatus and method for removably erecting a hoist.

In some embodiments a hoist is provided for assisting in the movement of a disabled person, comprising a fixed-length stanchion supportable at opposing longitudinal ends thereof to first and second support members fixed to a facility structural framework. The stanchion is removable from the support members without detaching any of the support members from the facility structural framework.

A method is provided for removably erecting a hoist to a structural framework of a facility for assisting in the movement of a disabled person, comprising: providing first and second support members fixed to the structural framework; placing a stanchion in longitudinal alignment with and clearingly between the support members; and moving one of the support members to an engaged position to supportingly engage the stanchion in a two-point supporting engagement at opposing ends of the stanchion.

The method can further comprise removing the stanchion from the first and second support members without removing the support members from the structural framework. The method further comprises providing third and fourth support members fixed to a different portion of the structural framework; placing the stanchion in longitudinal alignment with and clearingly between the third and fourth support members; and moving one of the third and fourth support members to an engaged position to supportingly engage the stanchion in a two-point supporting engagement at opposing ends of the stanchion.

A hoist is provided for assisting in movement of a disabled person, having a structural framework and means for erecting the structural framework to a facility. The means for erecting is characterized as inserting the framework between two supporting members and moving one of the supporting members to an engaged position, such means for erecting characterized as removing the framework from the supporting members without removing any of the supporting members.

These and various other features and advantages which characterize the claimed invention will become apparent upon reading the following detailed description and upon reviewing the associated drawings.

DESCRIPTION

Figure 1:
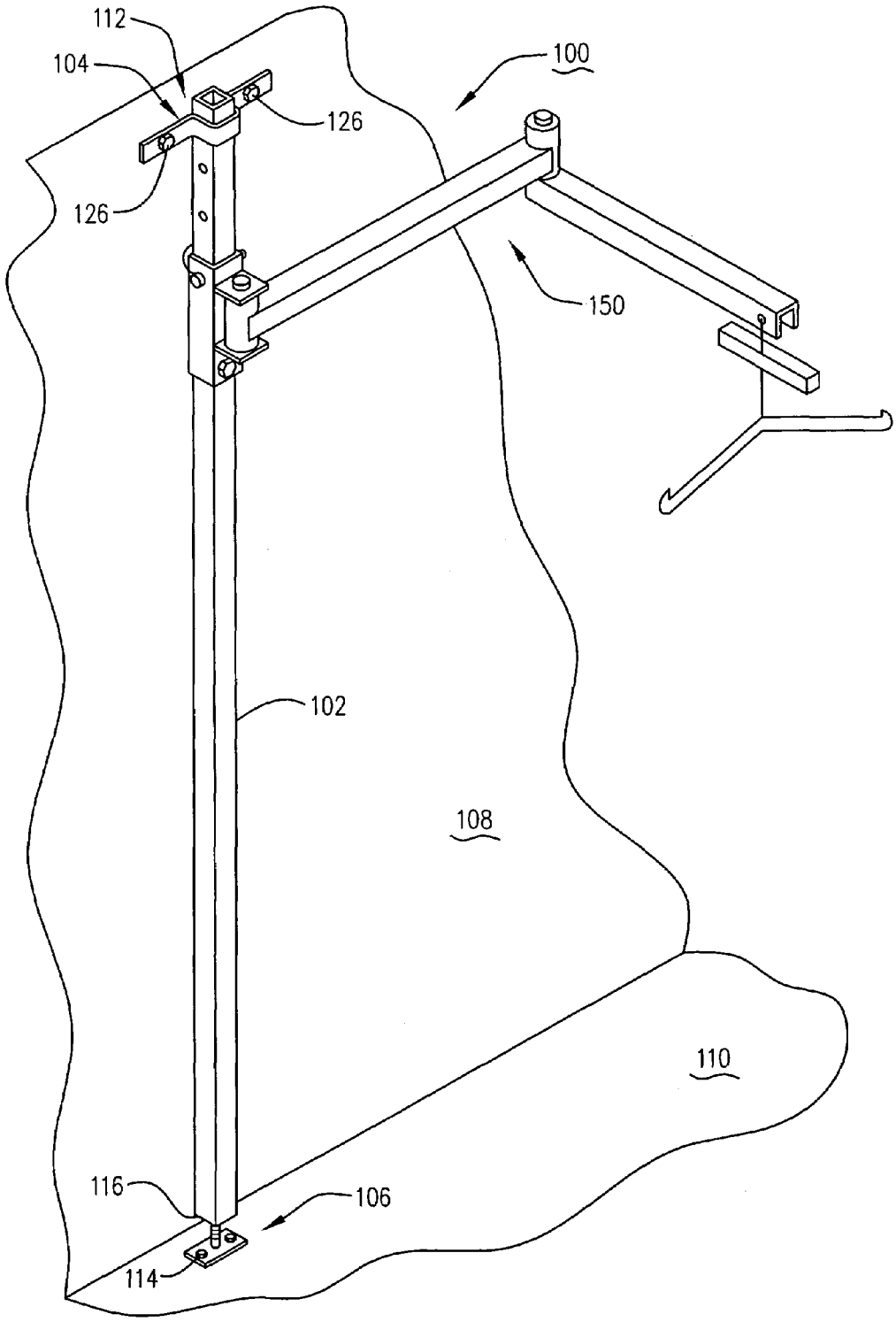
FIG. 1 is an isometric view of a hoist system constructed in accordance with embodiments of the present invention and attached to a wall.
Figure 2:
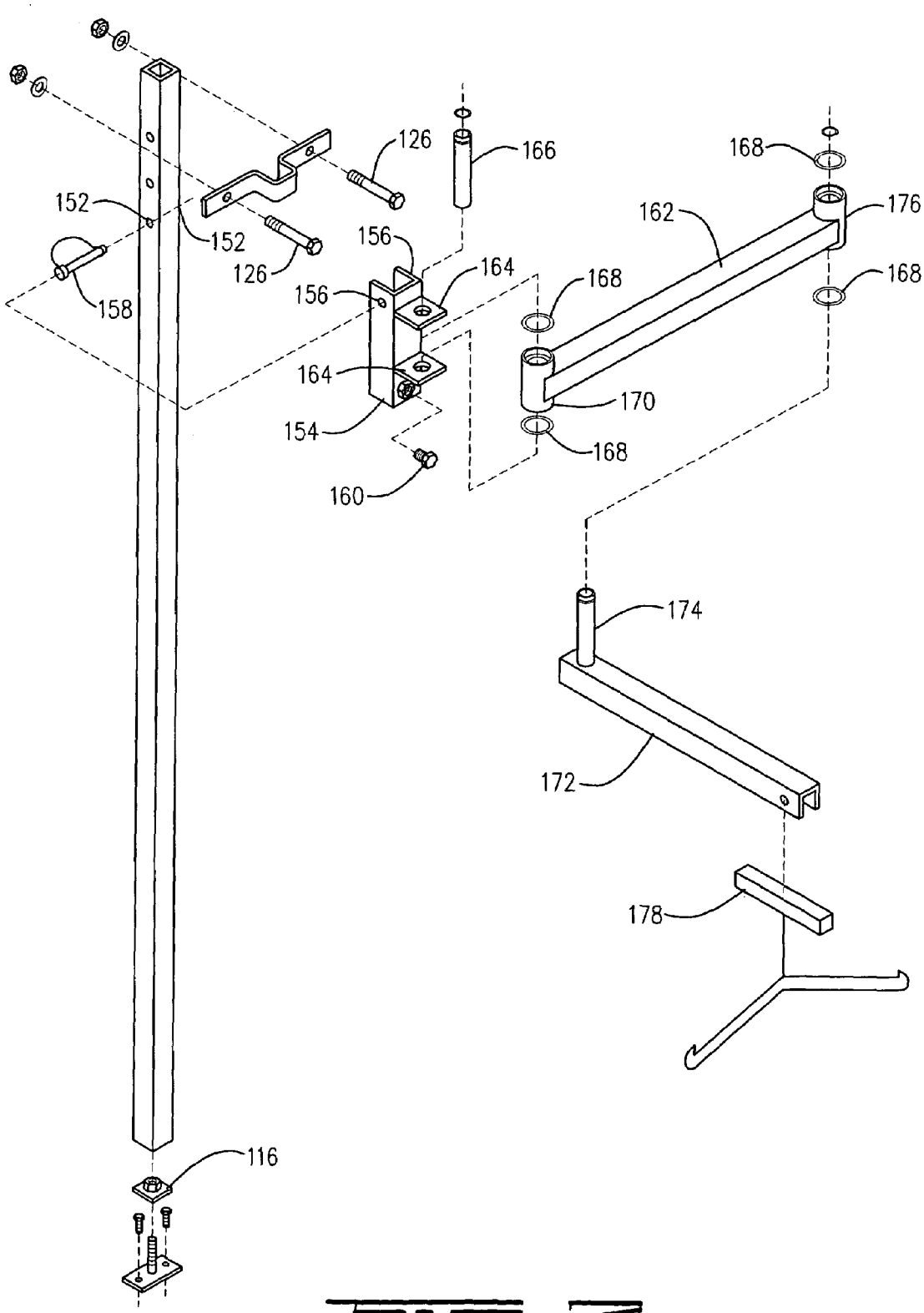
FIG. 2 is an exploded isometric view of the hoist system of FIG. 1.

Referring now to the drawings in general and more particularly to FIGS. 1 and 2, shown therein is a hoist 100 constructed in accordance with the present invention. The hoist 100 has a fixed-length stanchion 102 that is removably supportable at an upper end thereof by a first support member 104 and at a lower end thereof by a second support member 106.

As used herein, the term "fixed-length" means that the stanchion 102 is unitarily constructed of a single component, and for purposes of this description and the claims, the term "fixed-length" does not include a stanchion of multi-component assembly construction such as a telescoping construction. For use in lifting a disabled person, it has been determined that sufficient strength can be obtained by using two-inch square stainless steel tubing to construct the stanchion 102.

In the illustrative embodiments of FIG. 1 the support members 104, 106 are first fixed to wall 108 and floor 110 portions of the facility structural framework. Advantageously, the stanchion 102 can be easily attached to and removed from the support members 104, 106 without removing either of the support members 104, 106 from the structural framework. This construction permits erecting the hoist 100 as needed for use, and then further permits quick and easy removal of the hoist 100 for storage or use in another location. Where the hoist 100 is used in multiple locations on a recurring basis, a set of the support members 104, 106 are preferably installed in each of the desired locations in which the hoist 100 is used.

The embodiments of the present invention are not limited to the illustrative embodiment of FIG. 1 having the support member 104 fixed to the wall 108 and the support member 106 fixed to the floor 110. Generally, the support members are preferably attached to the appropriate structural framework members that are strong enough to lend the necessary structural integrity to the hoist 100. In alternative embodiments, for example, the support member 104 can be fixed to a ceiling or roof member, and the support member 106 can be fixed to the wall 108 as well.

The support member 104 is a clamp which defines a cavity 112 that is receivingly engageable with the cross section of the stanchion 102. In FIG. 1 the upper end of the stanchion 102 is shown disposed in the cavity 112 and thereby supported by the wall 108. Preferably, the stanchion 102 is slidingly engageable in the cavity 112 in a close mating relationship with the support member 104. For example, the support member 104 of FIG. 1 defines a three-sided cavity that cooperates with the wall 108 to define an enclosure closely conforming to the shape and size of the stanchion 102.

The support member 106 has a base 114 fixed to the floor 110. The support member 106 furthermore has a moveable bearing surface 116 for selectively providing a desired longitudinal distance between the bearing surface 116 and the cavity 112 of the support member 104.

Figure 3:
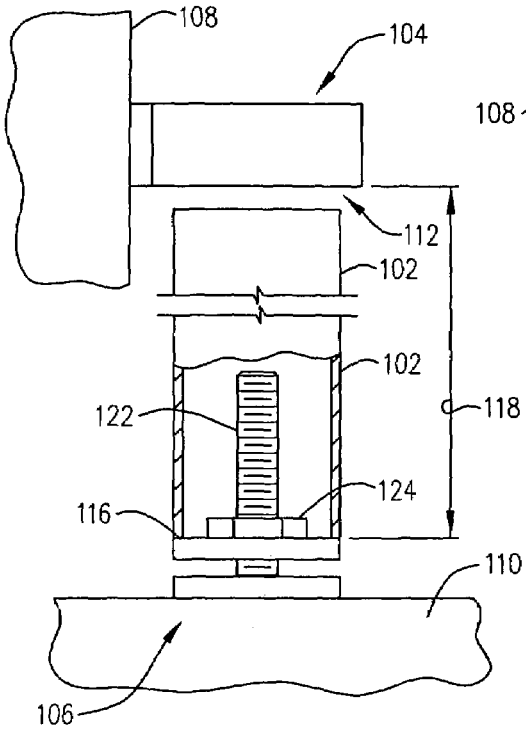
FIGS. 3 and 4 are diagrammatic illustrations of the hoist system in the disengaged and engaged modes, respectively.

Accordingly, embodiments of the present invention provide a support member 114 that is positionable between a disengaged mode and an engaged mode. FIG. 3 illustrates the disengaged mode in that the distance 118 between the bearing surface 116 and the adjacent end of the cavity 112 is greater than the longitudinal length of the stanchion 102. This permits the insertion of the stanchion 102 in longitudinal alignment between the support members 104, 106.

Figure 4:
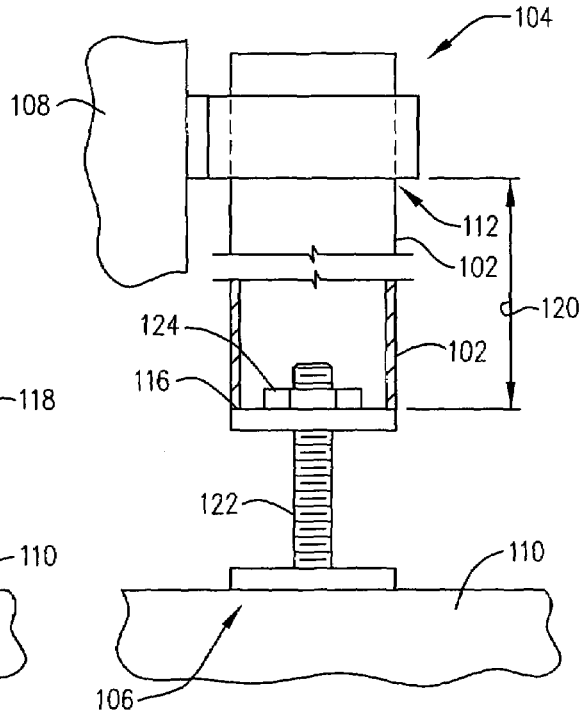

FIG. 4 contrarily illustrates the engaged mode in that the distance 120 between the bearing surface 116 and the adjacent end of the cavity 112 is less than the longitudinal length of the stanchion 102. In the engaged mode the bearing surface 116 pressingly engages against one end of the stanchion 102 and thereby translates the other end of the stanchion 102 into receiving engagement with the cavity 112. This provides a two-point supporting engagement by the structural framework of the opposing ends of the stanchion 102.

In some embodiments the bearing surface 116 is made moveable by threadingly engaging it with a threaded post 122 that extends from the base 114. A clearance opening is provided in the plate defining the bearing surface 116 and a threaded member 124, such as a nut, is attached to the plate, such as by welding. In alternative equivalent embodiments the bearing surface 116 can be made moveable in other manners, such as but not limited to pinning, blocking, or camming the plate defining the bearing surface 116 with respect to the base 114.

The support member 104 shown in FIG. 1 can be attached to the wall 108 by attaching one or more fasteners 126 to a structural supporting member, such as a header or a ceiling plate (not shown). Alternatively, the pair of fasteners 126 can straddle an upright stud (not shown) and connect to a shoring plate either inside or on the opposing side of the wall 108. In any event, such an arrangement is well suited for attaching the hoist 100 against the wall 108. In this arrangement it will be noted that the surface defining the cavity 112 is operably disposed substantially parallel with the longitudinal direction of the stanchion 102.

Figure 5:
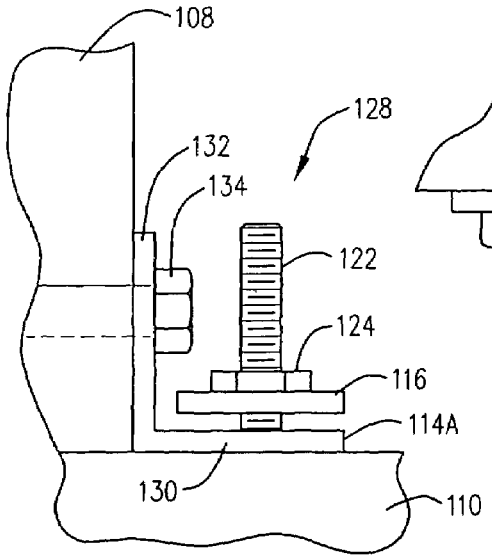
FIGS. 5 and 6 are elevational views of alternative support members.

As mentioned above, it may be advantageous to attach the support member 106 to the wall also. FIG. 5 illustrates an alternative support member 128 for doing so. The support member 128 has an angular base 114A with one side 130 supporting the moveable bearing surface 116, as above, but with the other side 132 attachable to the wall 108 such as with a fastener 134.

Figure 6:
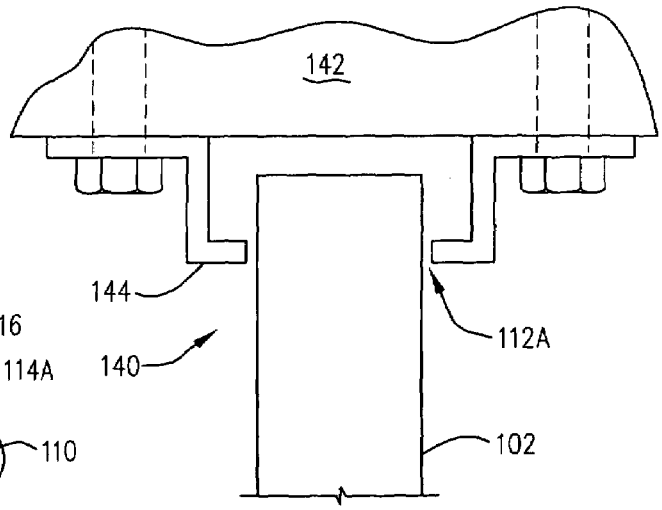

It may also be advantageous to use the hoist 100 at a location away from a wall 108, such as in the middle of a room adjacent to an entry location of a tub. FIG. 6 illustrates an alternative support member 140 for attaching the upper end of the stanchion 102 to a structural support member in the ceiling 142. It will be noted that in this arrangement the support member 140 has a surface 144 defining a cavity 112A that is operably disposed substantially orthogonal to the longitudinal direction of the stanchion 102.

Returning now to FIGS. 1 and 2, the hoist 100 further comprises an articulating arm assembly 150 depending from the stanchion 102. Preferably, the articulating arm assembly 150 can be quickly and easily attached to and removed from the stanchion 102 without the use of tools. This makes attaching the stanchion 102 to the support members 104, 106 easier by removing the weight and torsion of the articulating arm assembly 150.

In the present embodiments, openings 152 are provided in opposing sides of the stanchion 102. A mount 154 portion of the articulating arm assembly 150 defines a cavity that is receivingly engageable with a portion of the stanchion 102 cross section, and has openings 156 that are alignable with the openings 152. A fastener 158, such as a pin, can be inserted through the aligned openings 152, 156 of the stanchion 102 and mount 154, respectively, to secure the mount 154. A threaded member 160 can be advanced to pressingly engage a distal end thereof against the stanchion 102 in order to achieve a desired angle of the mount 154 relative to the longitudinal direction of the stanchion.

The articulating arm assembly 150 has an arm 162 journalled at a proximal end thereof to the mount 154 providing pivotal movement of the arm 162 in a plane substantially orthogonal to the longitudinal direction of the stanchion 102. The mount 154 provides supporting flanges 164 for a spindle 166. The spindle 166 provides a journal around which the hub 170 is rotatable upon a pair of bearings 168.

The articulating arm assembly 150 further has an arm 172 journalled at a proximal end thereof to the distal end of the arm 162 for pivotal movement of the second arm 172 in relation to the arm 162 in a substantially parallel plane. The arm 172 has a spindle 174 at a proximal end thereof that is receivingly engageable within a hub 176 formed at a distal end of the arm 162. The spindle 174 provides a journal around which the hub 176 is rotatable upon a pair of bearings 168. A winch 178, such as an electric, pneumatic or hydraulic type, is supported by the distal end of the arm 172.

Figure 7:
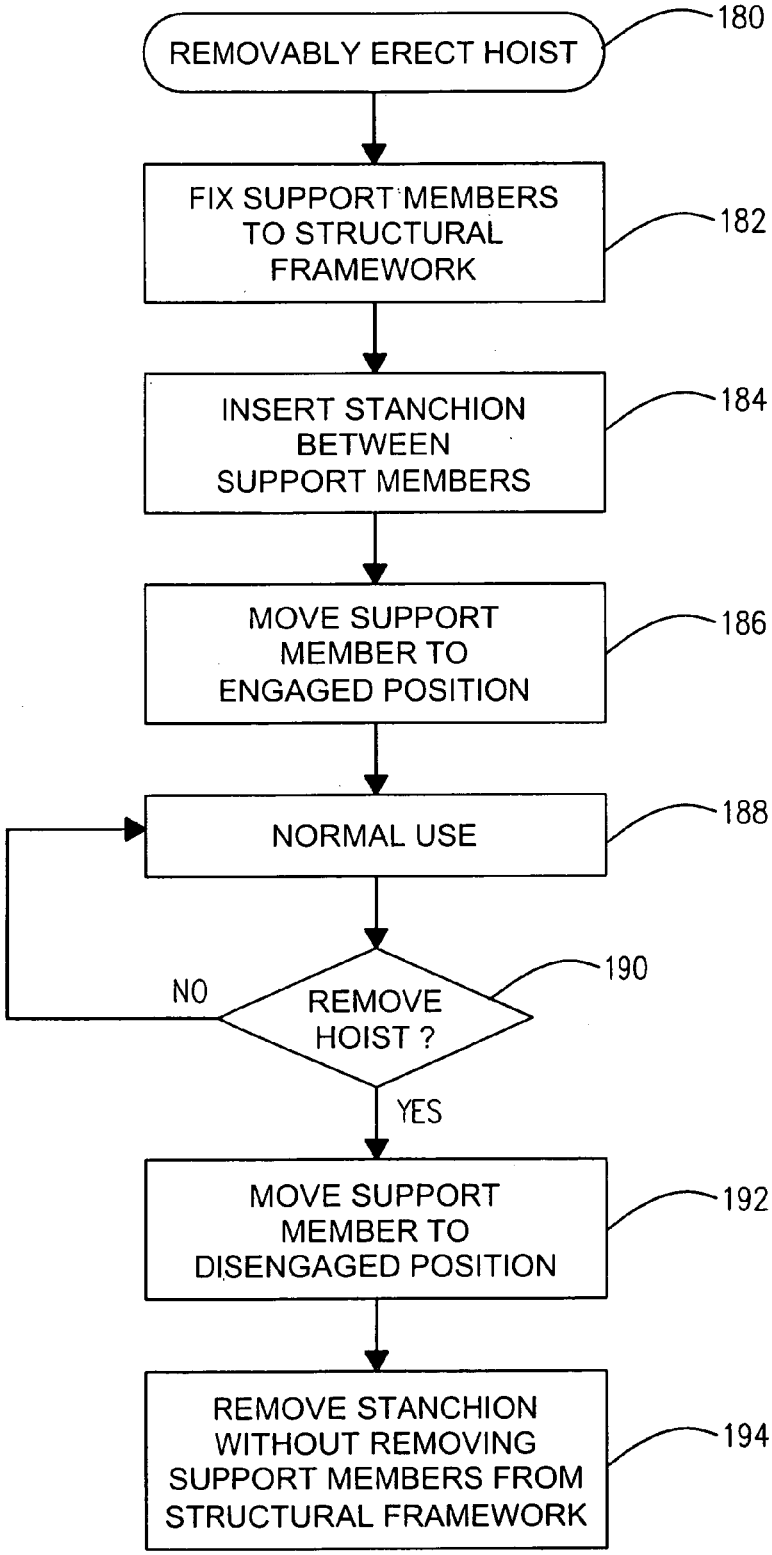
FIG. 7 is a flowchart illustrating steps for removably erecting the hoist system of FIG. 1.

FIG. 7 is a flowchart illustrating steps of removably erecting the hoist in accordance with embodiments of the present invention. The method 180 begins in block 182 by fixing the support members 104, 106 to the facility structural framework, such as the wall, floor, and/or ceiling structure of the facility. In block 184 the stanchion 102 is inserted in longitudinal alignment between the support members 104, 106. In block 186 the support member 106 is moved to the engaged position, thereby translating the opposing end of the stanchion into supporting engagement with the support member 104. Normal use of the hoist 100 begins in block 188. In decision block 190 it is determined whether the hoist 100 is to be removed. If no, then normal use continues in block 188; if yes, then control passes to block 192 where the support member 106 is returned to the disengaged position. The stanchion 102 is then removed from the support members 104, 106 without removing any of the support members 104, 106 from the facility structural framework. The method can further comprise fixing third and fourth support members at a different location of the facility structural framework, and repeating the steps of FIG. 7 in relation to the third and fourth support members.

It is to be understood that even though numerous characteristics and advantages of various embodiments of the present invention have been set forth in the foregoing description, together with details of the structure and function of various embodiments of the invention, this detailed description is illustrative only, and changes may be made in detail, especially in matters of structure and arrangements of parts within the principles of the present invention to the full extent indicated by the broad general meaning of the terms in which the appended claims are expressed. For example, the particular elements may vary depending on the particular manner of moving a support member to the engaged position without departing from the spirit and scope of the present invention.

In addition, although the embodiments described herein are directed to a hoist for moving a disabled person, it will be appreciated by those skilled in the art that the claimed subject matter is not so limited and can be employed as various other lifting systems without departing from the spirit and scope of the claimed invention.

What is claimed is:

1. A method for removably erecting a hoist to a structural framework of a facility for assisting in the movement of a disabled person, comprising:

providing first and second support members fixed to the structural framework the first support member comprising a clamp defining a cavity that is receivingly engageable with a stanchion in a substantially close mating relationship, the clamp being operably fixed to a generally vertical wall;

placing a fixed length stanchion in longitudinal alignment with and clearingly between the support members; and moving one of the support members to an engaged position to supportingly engage the stanchion in a two-point supporting engagement at opposing ends of the stanchion.

2. The method of claim 1 wherein providing the second support member step comprises providing a bearing surface that is moveable to define a desired distance between the bearing surface and the clamp.

3. The method of claim 2 wherein the moving step comprises moving the bearing surface toward the clamp to an engaged position, thereat pressingly engaging against one end of the stanchion and translating the opposing end of the stanchion into receiving engagement within the clamp cavity.

4. The method of claim 3 wherein the moving step comprises threadingly advancing the bearing surface.

5. The method of claim 1 further comprising removing the stanchion from the first and second support members without removing any of the support members from the structural framework.

6. The method of claim 5 further comprising:

providing third and fourth support members fixed to a different portion of the structural framework;

placing the stanchion in longitudinal alignment with and clearingly between the third and fourth support members; and moving one of the third and fourth support members to an engaged position to supportingly engage the stanchion in a two-point supporting engagement at opposing ends of the stanchion.

7. A hoist adapted to assist the movement of a disabled person comprising a first and second support member, and a fixed-length stanchion supportable at opposing longitudinal ends thereof to the first and second support members fixed to a facility structural framework, the stanchion being removable from the support members without detaching any of the support members from the facility structural framework, the first support member comprising a clamp defining a cavity that is receivingly engageable with a cross section of the stanchion in a substantially close mating relationship, the clamp being operably fixed to a generally vertical wall, the stanchion being in a longitudinal alignment with and clearingly between the support members, whereby one of the support members is movable to an engaged position to supportingly engage the stanchion in a two-point supporting engagement at opposing ends of the stanchion.

8. The hoist of claim 7 wherein the second support member comprises a bearing surface that is moveable to selectively vary a longitudinal distance between the bearing surface and the clamp.

9. The hoist of claim 8 wherein the bearing surface is positionable between a disengaged mode and an engaged mode, wherein the distance between the bearing surface and the clamp is greater than a longitudinal length of the stanchion in the disengaged mode, and wherein the distance between the bearing surface and the clamp is less than the longitudinal length of the stanchion in the engaged mode.

10. The hoist of claim 9 further comprising an articulating arm assembly depending from the stanchion and supporting a winch.

11. The hoist of claim 10 wherein the articulating arm assembly comprises a mount defining a cavity that is receivingly engageable with a portion of the stanchion cross sectional area, the mount defining an opening that is alignable with an opening defined by the stanchion for passing a fastener through both the mount and the stanchion, the articulating arm assembly further comprising an arm journalled at a proximal end thereof to the mount for pivotal movement in a plane substantially orthogonal to the longitudinal direction of the stanchion.

12. The hoist of claim 11 wherein the articulating arm assembly further comprises a second arm journalled at a proximal end thereof to a distal end of the arm for pivotal movement of the second arm in relation to the arm and in a substantially parallel plane.

13. The hoist of claim 8 wherein the second support member comprises a longitudinally extending post and wherein the bearing surface threadingly engages the post.

14. The hoist of claim 7 wherein the first support member comprises a surface defining the cavity that is operably disposed substantially parallel with the stanchion.

15. The hoist of claim 7 wherein the first support member comprises a surface defining the cavity that is operably disposed substantially orthogonal to the stanchion.

* * * * *